United States Patent [19]

Barto

[11] Patent Number: 4,778,091

[45] Date of Patent: Oct. 18, 1988

[54] BACKPACKER'S CHILD CARRIER APPARATUS

[76] Inventor: Burnett V. Barto, 290 Spring Valley, Milpitas, Calif. 95035

[21] Appl. No.: 68,086

[22] Filed: Jun. 30, 1987

[51] Int. Cl.[4] ..... A45F 3/08

[52] U.S. Cl. ..... 224/211; 224/158; 224/159

[58] Field of Search ..... 224/157–161, 224/210, 211, 209, 214; 297/118

[56] References Cited

U.S. PATENT DOCUMENTS

| | | | |
|---|---|---|---|
| 2,535,683 | 12/1950 | Kimball | 224/159 |
| 2,537,864 | 1/1951 | Skaer | 224/159 |
| 3,322,312 | 5/1967 | Mitchell | 224/211 |
| 3,575,326 | 4/1971 | Chappell | 224/159 |
| 3,780,919 | 12/1973 | Hansson . | |
| 3,871,562 | 3/1975 | Grenier . | |
| 4,271,998 | 6/1981 | Ruggiano | 224/160 |
| 4,402,440 | 9/1983 | Purtzer et al. . | |
| 4,416,403 | 11/1983 | Johnson | 224/159 X |
| 4,492,326 | 1/1985 | Storm . | |

FOREIGN PATENT DOCUMENTS

| | | | |
|---|---|---|---|
| 908399 | 4/1946 | France | 224/211 |
| 63451 | 4/1941 | Norway | 224/210 |

OTHER PUBLICATIONS

New York Daily News Photo, 2/1949, showing man with child carriers on back and front.

*Primary Examiner*—Henry J. Recla
*Assistant Examiner*—Robert Petrik
*Attorney, Agent, or Firm*—Henderson & Sturm

[57] ABSTRACT

A child carrier apparatus (10) specifically designed for use in combination with a backpack (100) having two vertically projecting main frame members (103); wherein, the child carrier apparatus (10) includes a primary strap unit (11) having adjustable loops (17) that are operatively attached to the vertically projecting main frame members (103); and, an auxiliary strap unit (12) that cooperates with the primary strap unit (11) to form a chair sling assembly (20) that supports and suspends a child within the apparatus.

4 Claims, 1 Drawing Sheet

FIG. 1.
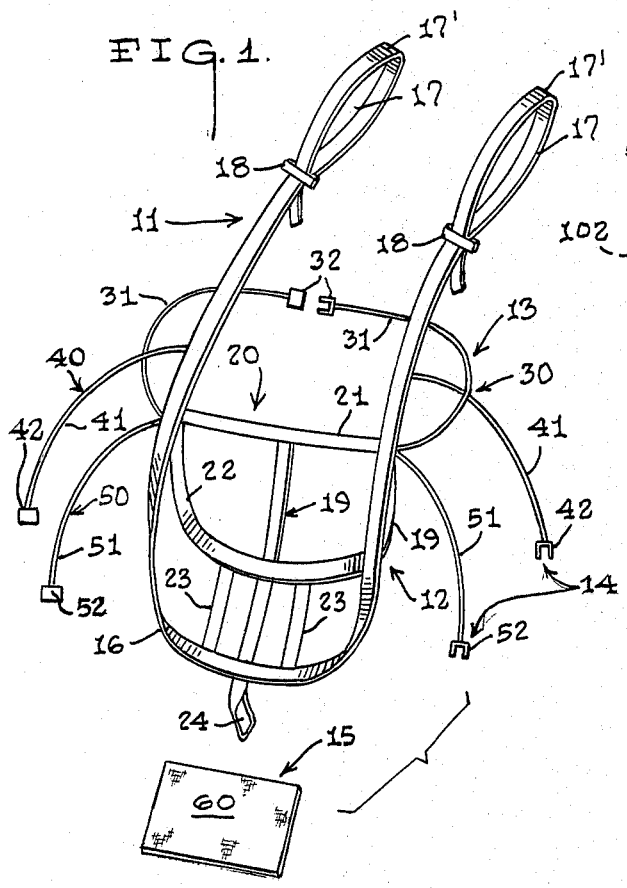
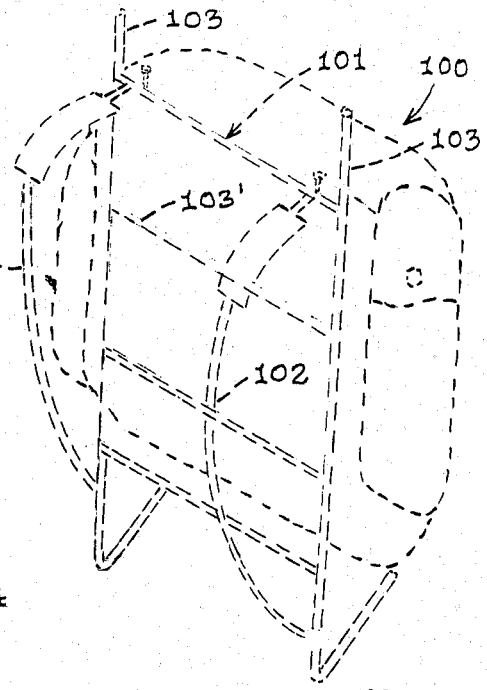
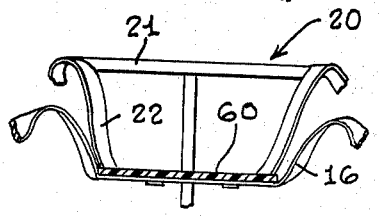
FIG. 2.
FIG. 3.
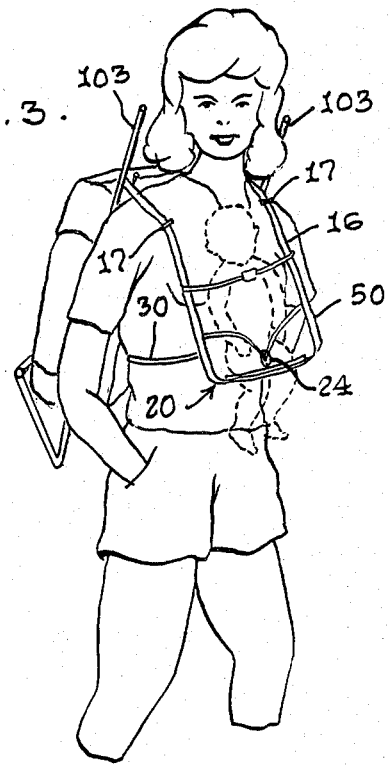
FIG. 4.
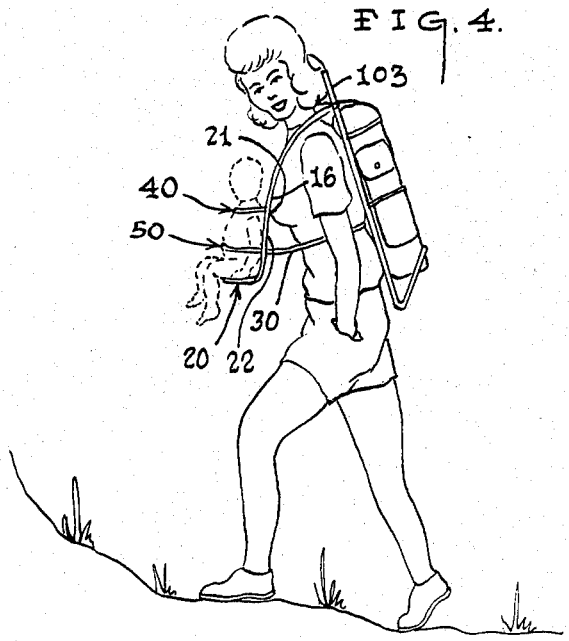

BACKPACKER'S CHILD CARRIER APPARATUS

TECHNICAL FIELD

The present invention relates generally to the field of soft infant carriers.

BACKGROUND OF THE INVENTION

As can be seen by reference to the following U.S. Pat. Nos. 4,402,440; 3,780,919; 3,871,562; and 4,492,326 the prior art is replete with myriad and diverse soft infant carriers developed to assist a parent in transporting a child from one location to another.

While all of the aforementioned prior art constructions are more than adequate to fulfill their intended purpose and function, these devices do suffer from at least one major shared deficiency in that over an extended period of time the parent wearing the device begins to suffer from back strain. In addition, the infant carriers that support the child on the parent's chest cause much more strain on the parent's back than the knapsack style carriers.

In the latter version the child is supported in a piggyback fashion and due to the distribution of the childs weight higher on the parent's torso, coupled with the fact that by leaning forward the parent can shift the childs weight directly over the parent's pelvic area; the cumulative weight of the parent's upper torso and the child can be more evenly distributed over the parent's lower torso, thereby lessening the back strain imposed on the parent.

It should also be noted that given the fact that men and women have different centers of gravity with a woman's center of gravity being lower than that of a man's, the male parent prefers the knapsack style infant carrier that supports the child closer to his own center of gravity while the female parent prefers the chest supported carrier for similar reasons.

While the foregoing problems with the patented prior art constuctions represent relatively minor physical discomfort and/or aggravation in an urban environment, these problems become greatly magnified for active outdoor type parents that enjoy hiking, backpacking, and wilderness camping. Anyone who is familiar with these outdoor pursuits will quickly realize and appreciate the problems that are compounded, when it is necessary to physically transport a child over long distances and uneven terrain, in addition to carrying the gear and equipment that are normally associated with such endeavors.

Obviously there has existed a long felt need for a soft child carrier specifically designed for backpacker's, in as much as, the commercially available products are poorly suited for use in such a rugged environment; and, that specific objective has been satisfied by the development of the apparatus that forms the basis of this invention.

SUMMARY OF THE INVENTION

The present invention comprises in general a pair of flexible strap units operatively connected to one another to form a flexible child encompassing support structure; wherein, the primary strap unit is adapted to be releasably secured to the upper portion of a conventional back pack frame; and, wherein the auxiliary strap unit is designed to cooperate with the primary strap unit to provide a flexible sling type chair assembly for the child.

In addition, the present invention is further provided with a first securing means that operatively attaches the strap assembly to the parent's upper torso; and, a second securing means for effectively restraining a child within the sling type chair support.

The apparatus of the present invention further contemplates the use of a padded seat unit that may be interposed between the flexible sling type chair assembly and the child for the purpose of affording both comfort and additional support for the infant while sitting within the chair sling assembly.

A child carrier built in accordance with the principals of the present invention not only acts as a counterbalance to the weight of the backpack and allows the parent free use of their arms while negotiating difficult terrain; but, this arrangement is particularly useful while the parent is traversing on uphill grade in that the sling assembly will pivot away from the parent's body, to not only provide a more comfortable support position for the child, but also to minimize the possibility that the child would be injured in the event that the parent should stumble and fall.

Another advantage of the present invention is the fact that the child carrier apparatus is both flexible and lightweight, which will permit the apparatus to be folded up and stored in the parent's backpack when not in sue, while adding very little additional weight to the back pack contents.

BRIEF SUMMARY OF THE DRAWINGS

These and other objects, advantages, and novel features of the invention will become apparent from the detailed description of the best mode for carrying out the preferred embodiment of this invention which follows, particularly when considered in conjunction with the accompanying drawings wherein:

FIG. 1 is an exploded perspective view of the components that comprise the apparatus;

FIG. 2 is an enlarged detail view of the sling assembly of the apparatus;

FIG. 3 is a perspective view of the disposition of the apparatus on an upright adult; and, FIG. 4 illustrates the disposition of the apparatus as an adult traverses an uphill grade.

BEST MODE FOR CARRYING OUT THE INVENTION

As can be seen by reference to the drawings and in particular to FIG. 1, the backpacker's child carrier apparatus that forms the basis of the present invention is designated generally by the reference numeral (10). As was mentioned earlier in the specification, the apparatus (10) was developed to be used specifically in combination with a conventional backpack (100) having a tubular pack frame (101) provided with a pair of shoulder straps (102); wherein, the pack frame (101) is further provided with at least two vertical main frame members (103) operatively connected by at least two horizontal main frame members (103').

The backpacker's child carrier apparatus (10) comprises in general: a primary strap unit (11); an auxiliary strap unit (12); a first securing means (13); a second securing means (14); and, a seat unit (15). These units and means will now be described in seriatim fashion.

As can best be seen by reference to FIG. 1, the primary strap unit (11) comprises an elongated, generally U-shaped flexible strap member (16) having adjustable loops (17) formed on its ends (17'); wherein, the size of the adjustable loops (17) are controlled by releasable clasp members (18) such as a buckle, or the like, whereby the primary strap unit (11) may be operatively engaged with either the upper horizontal (103') or the pair of vertical frame members (103) of the conventional pack frame (101).

The auxiliary strap unit (12) comprises a plurality of strap elements (19) that are joined to one another, and to the intermediate portion of the primary strap unit (11) to form a chair sling assembly designated generally as (20). As viewed from top to bottom in FIG. 1 the plurality of strap elements (19) comprise a T-shaped back strap element (21); wherein, the arms of the strap element (21) are attached on opposite ends to the primary strap member (16); a U-shaped back strap element (22) attached on opposite ends to the primary strap member (16); wherein, the intermediate portion of the U-shaped strap element (22) is connected to the leg of the T-shaped strap element (21); and, a plurality of seat strap elements (23) has a looped portion (24) which projects beyond the periphery of the elongated strap member (16).

Still referring to FIG. 1, it can be seen that the first securing means (13) comprises an elongated adjustable belt element (30) including a pair of belt segments (31) attached on opposite arms of the U-shaped strap member (16) and having cooperating releasable conventional clasping elements (32) disposed on their respective ends. As can be appreciated by reference to FIGS. 3 and 4, the elongated adjustable belt element (30) secures the lower portion of the child carrier apparatus (10) around the parent's torso; whereby, the belt element (30) can be fitted snugly for normal usage and loosely disposed for uphill travel.

The second securing means (14) comprises an upper torso adjustable belt element (40) comprising a pair of relatively short belt segments (41) attached on opposite arms of the U-shaped strap member (16) and having cooperating releasable conventional clasping elements (42) disposed on their respective ends; wherein, the belt segments (41) are provided to partially encompass a child's chest when a child is placed within the apparatus.

In addition, the second securing means (14) further comprises a lower torso adjustable belt element (50) comprising a pair of intermediate length belt segments (51) attached on opposite arms of the U-shaped strap member (16) and having cooperating releasable conventional clasping elements (52) disposed on their respective ends; wherein, the belt segments (51) are provided to encircle each of a child's legs between the respective belt segments (51) the strap member (16) and the looped portion (24) of one of the seat strap elements (23); wherein, the belt segments (51) are joined together and pass through the looped portion (24) to captively engage the child's legs.

As can best be seen by reference to FIGS. 1 and 2, the seat unit (15) comprises a generally rectangular seat member (60) dimensioned to be received within the chair sling assembly (20); wherein, the seat member (60) of the preferred embodiment comprises a pad of lightweight synthetic material such as foamed polyurethane or the like.

The backpacker's child carrier apparatus (10) is normally operatively deployed by the child's parent before they have slipped on and adjusted their backpack in the usual manner. Prior to donning the pack frame (101) the parent operatively connects the adjustable loops (17) of the primary strap unit over either the upper horizontal frame member (103') or the pair of vertical frame members (103) of the pack frame (101) to suspend the apparatus (10) therefrom. After the adjustable loops (17) have been selectively positioned by the parent, the elongated adjustable belt element (30) of the first securing means (13) is deployed around the parent's upper torso to operatively connect the apparatus (10) to both the parent and the backpack.

At this juncture the seat unit (15) may be optionally employed within the chair sling assembly (20); whereupon, the child is then placed within the chair sling assembly (20), and the second securing means are then operatively deployed to maintain the child in a captive disposition relative to the sling assembly (20).

Having thereby described the subject matter of this invention, it should be obvious that many substitutions, modifications, and variations of this apparatus (10) are possible in light of the above teachings. It is therefore to be understood that the invention as taught and described herein is only to be limited to the extent of the breadth and scope of the appended claims.

I claim:

1. A child carrier apparatus in combination with a conventional backpack including a pack frame having at least two vertical main frame members and at least two horizontal frame members; wherein, the child carrier apparatus comprises:

a primary strap unit comprising an elongated generally U-shaped flexible strap member having adjustable loops formed on its ends whereby the adjustable loops are operatively connected to at least one of the said main frame members;

an auxiliarly strap unit comprising a plurality of strap elements including a generally U-shaped strap element, a generally T-shaped strap element; and, a plurality of seat strap elements; wherein, said strap elements are operatively connected to one another end to said elongated strap member; and wherein the auxilialry strap unit is operatively connected to the primary strap unit to form a sling chair assembly that will support a child;

a first securing means for operatively attaching the primary and auxiliary strap units to the torso of a parent; and, a second securing means for operatively restraining a child within the said sling chair asembly; wherein the U-shaped primary strap unit forms a U having a bottom that is disposed at approximately waist level and directly in front of the user; and, wherein the sling chair assembly is disposed at the said bottom of the U.

2. The combination of claim 1 wherein said apparatus further includes:

a seat unit comprising a generally rectangular seat member that is dimensioned to be received within said chair sling assembly.

3. The combination of claim 1 wherein the adjustable loops of the primary strap unit are operatively connected to one of said two horizontal main frame members.

4. The combination of claim 1 wherein the adjustable loops of the primary strap unit are operatively connected with two of said vertical main frame members.

* * * * *